US010183834B2

(12) United States Patent
Charest et al.

(10) Patent No.: US 10,183,834 B2
(45) Date of Patent: Jan. 22, 2019

(54) TOOL-LESS CABLE RETAINER

(71) Applicant: Cisco Technology, Inc., San Jose, CA (US)

(72) Inventors: Glenn Patrick Charest, San Jose, CA (US); Dan Hruska, San Carlos, CA (US); Aditya Prabhakar, San Mateo, CA (US)

(73) Assignee: Cisco Technology, Inc., San Jose, CA (US)

( * ) Notice: Subject to any disclaimer, the term of this patent is extended or adjusted under 35 U.S.C. 154(b) by 856 days.

(21) Appl. No.: 14/617,237

(22) Filed: Feb. 9, 2015

(65) Prior Publication Data

US 2016/0229661 A1 Aug. 11, 2016

(51) Int. Cl.
*B65H 75/22* (2006.01)
*B65H 75/14* (2006.01)

(52) U.S. Cl.
CPC ..... *B65H 75/22* (2013.01); *B65H 75/14* (2013.01); *B65H 2701/34* (2013.01)

(58) Field of Classification Search
CPC ..... B65H 2701/34; B65H 75/14; B65H 75/22
USPC ..... 242/608.6, 118.61
See application file for complete search history.

(56) References Cited

U.S. PATENT DOCUMENTS 1,862,405 A 6/1932 Johnson
2,051,212 A 8/1936 Hallett et al.
2,575,131 A 11/1951 Salkin
3,113,742 A * 12/1963 Bevan ..... H04L 13/06 242/539
3,393,790 A 7/1968 Dixon et al.
4,128,215 A * 12/1978 Underwood ..... B65H 75/14 242/608.6
4,500,047 A 2/1985 Merlin
4,629,136 A * 12/1986 Vallance ..... B65H 75/22 242/587.2
5,335,873 A * 8/1994 Harris ..... B65H 16/00 242/348
5,897,075 A * 4/1999 Elder ..... B65H 75/22 242/118.6
6,045,087 A 4/2000 Vislocky et al.
6,343,765 B1 * 2/2002 Wen ..... B65H 75/14 242/609.1

(Continued)

*Primary Examiner* — William A. Rivera
*Assistant Examiner* — Mark K Buse
(74) *Attorney, Agent, or Firm* — Edell, Shapiro & Finnan, LLC

(57) ABSTRACT

Example embodiments relate to an apparatus comprising a first flange part; a second flange part comprising a hole and one of a male portion or a female portion; and a spindle comprising a first axial end, an axial body, a second axial end and an other of the male portion or the female portion arranged on the second axial end of the spindle. The first axial end of the spindle is rigidly connected to the first flange part, while the second axial end of the spindle extends through the hole so that the male portion extends into the female portion to secure the spindle part to the second flange part and so that the axial body extends between the first flange part and the second flange part. The male portion or the female portion is elastically deformable to allow the male portion to be removed from the female portion and the spindle to be removed from the second flange part.

20 Claims, 7 Drawing Sheets

(56) References Cited

U.S. PATENT DOCUMENTS

| | | | | |
|---|---|---|---|---|
| 6,364,246 | B1 * | 4/2002 | Huang | B65H 75/22 242/608.5 |
| 6,851,964 | B2 | 2/2005 | Miller | |
| 7,108,222 | B1 * | 9/2006 | Schaefer | B65H 75/22 242/608.6 |
| 7,121,501 | B1 * | 10/2006 | Lea | B65H 75/14 242/608.2 |
| 7,300,220 | B1 | 11/2007 | Bakker | |
| 9,786,429 | B2 * | 10/2017 | Liu | H01F 27/306 |
| 2004/0011916 | A1 * | 1/2004 | Zide | B65H 75/14 242/608.6 |
| 2004/0118962 | A1 * | 6/2004 | Limber | B65H 75/14 242/405.2 |
| 2009/0314876 | A1 * | 12/2009 | Kessler | B29C 39/028 242/608.6 |
| 2016/0355371 | A1 * | 12/2016 | Baranov | B65H 75/14 |

* cited by examiner

TOOL-LESS CABLE RETAINER

TECHNICAL FIELD

The present disclosure relates to cable retainers.

BACKGROUND

Servers are installed in cabinets via a pair of rail assemblies. Ribbon cables are used to interconnect between different portions of a single server, or between different servers within the same cabinet. Cable retainers are used to ensure that the ribbon cables are well organized.

In order for the cables to be replaced or moved during maintenance of the servers, cable retainers may be disassembled. Devices such as screws may be used to keep the cable retainer in an assembled state during operation of the server. Tools such as screwdrivers are then necessary to disassemble the cable retainer for maintenance. During disassembly, screws and screwdrivers may be dropped or lost, sometimes falling into the servers themselves.

DESCRIPTION OF EXAMPLE EMBODIMENTS

Overview

Example embodiments disclosed herein relate to an apparatus comprising a first flange part; a second flange part comprising a hole and one of a male portion or a female portion; and a spindle comprising a first axial end, an axial body, a second axial end and another of the male portion or the female portion arranged on the second axial end of the spindle. The first axial end of the spindle is rigidly connected to the first flange part, while the second axial end of the spindle extends through the hole so that the male portion extends into the female portion to secure the spindle part to the second flange part and so that the axial body extends between the first flange part and the second flange part. The male portion or the female portion is elastically deformable to allow the male portion to be removed from the female portion and the spindle to be removed (unsecured) from the second flange part.

Example Embodiments

Figure 1:
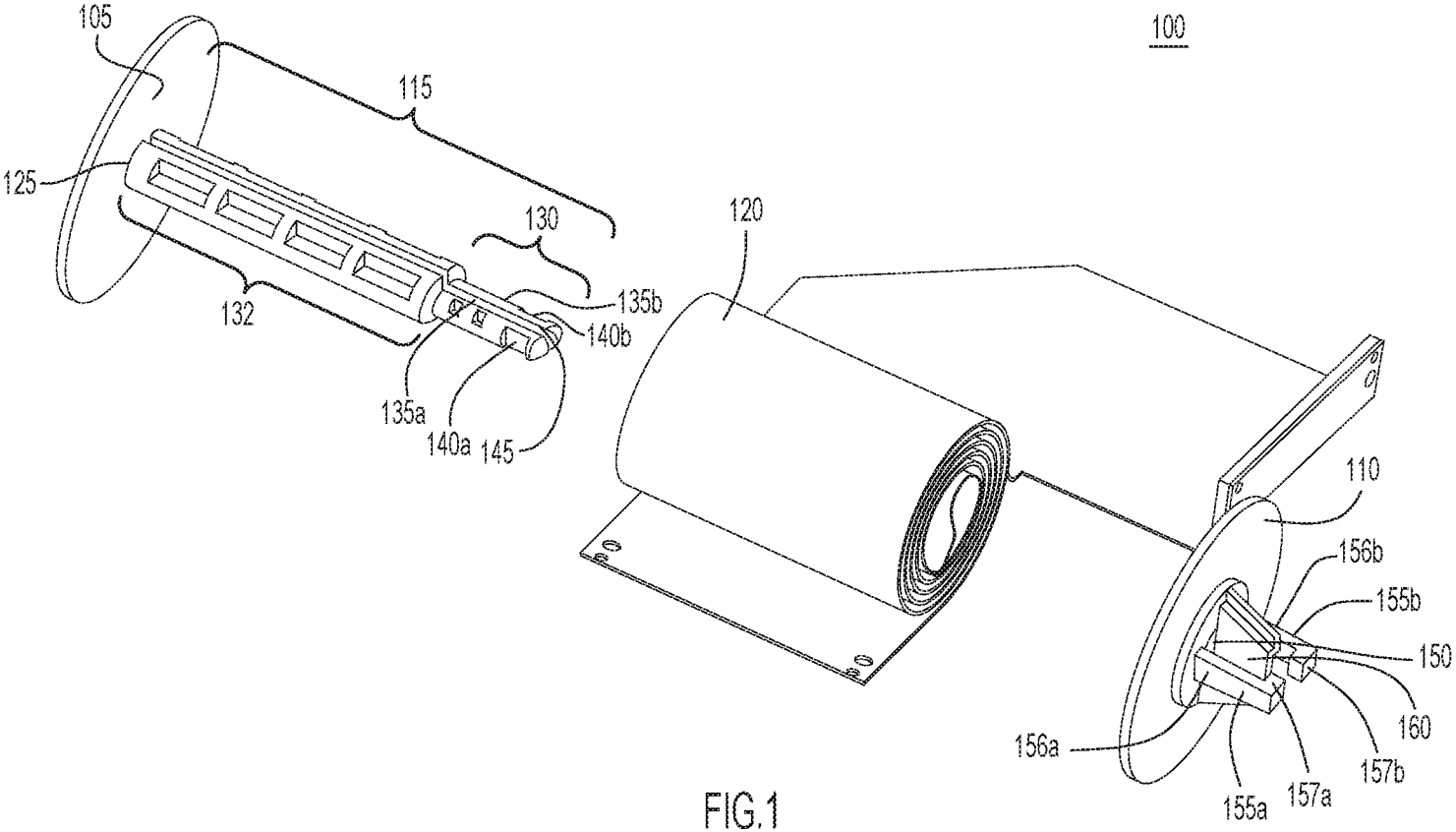
FIG. 1 is an exploded view of a tool-less cable retainer according to a first example embodiment.

With reference to FIG. 1, depicted therein is an exploded view of a cable retainer 100 that can be assembled and disassembled without a tool. Cable retainer 100 is formed from a first flange 105, a second flange 110 and a spindle

115, and is constructed so that second flange 110 can be removed from spindle 115 without the use of a tool. Accordingly, cable 120 can be easily accessed, removed from, or rearranged on spindle 115.

According to the example embodiment of FIG. 1, a first axial end 125 of spindle 115 is monolithically (integrally) formed with first flange 105. Axial body 132 of spindle 115 extends between first flange 105 and second flange 110, and second axial end 130 of spindle 115 is configured to be removably attached to second flange 110. In order to facilitate the removable attachment of second axial end 130 to second flange 110, second axial end 130 is constructed to include a first leg 135*a* and a second leg 135*b*. First leg 135*a* and second leg 135*b* are separated by slit 145, and each leg is formed with an engagement portion, in this example, first female portion 140*a* and second female portion 140*b*, respectively. Slit 145 may extend the entire length of second axial end 130 and axial body 132, or may simply extend through some or all of first leg 135*a* and second leg 135*b*. First leg 135*a* and second leg 135*b* are designed to be inserted through hole 150 in second flange 110. Second axial end 130 is configured to be inserted into hole 150 such that each of first leg 135*a* and 135*b* is arranged on an opposite side of cross member 160, with extends along a diameter of hole 150. Cross member 160 prevents spindle 115 from rotating.

Once inserted through hole 150, first female portion 140*a* and second female portion 140*b* are engaged by first male portion 155*a* and second male portion 155*b*, respectively, which are arranged on the outside face of second flange 110. As used herein, the outside face of second flange 110 refers to the face opposite first flange 105. First male portion 155*a* and second male portion 155*b* prevent spindle 115 from moving in an axial direction based on their engagement in first female portion 140*a* and second female portion 140*b*, respectively.

Figure 2:
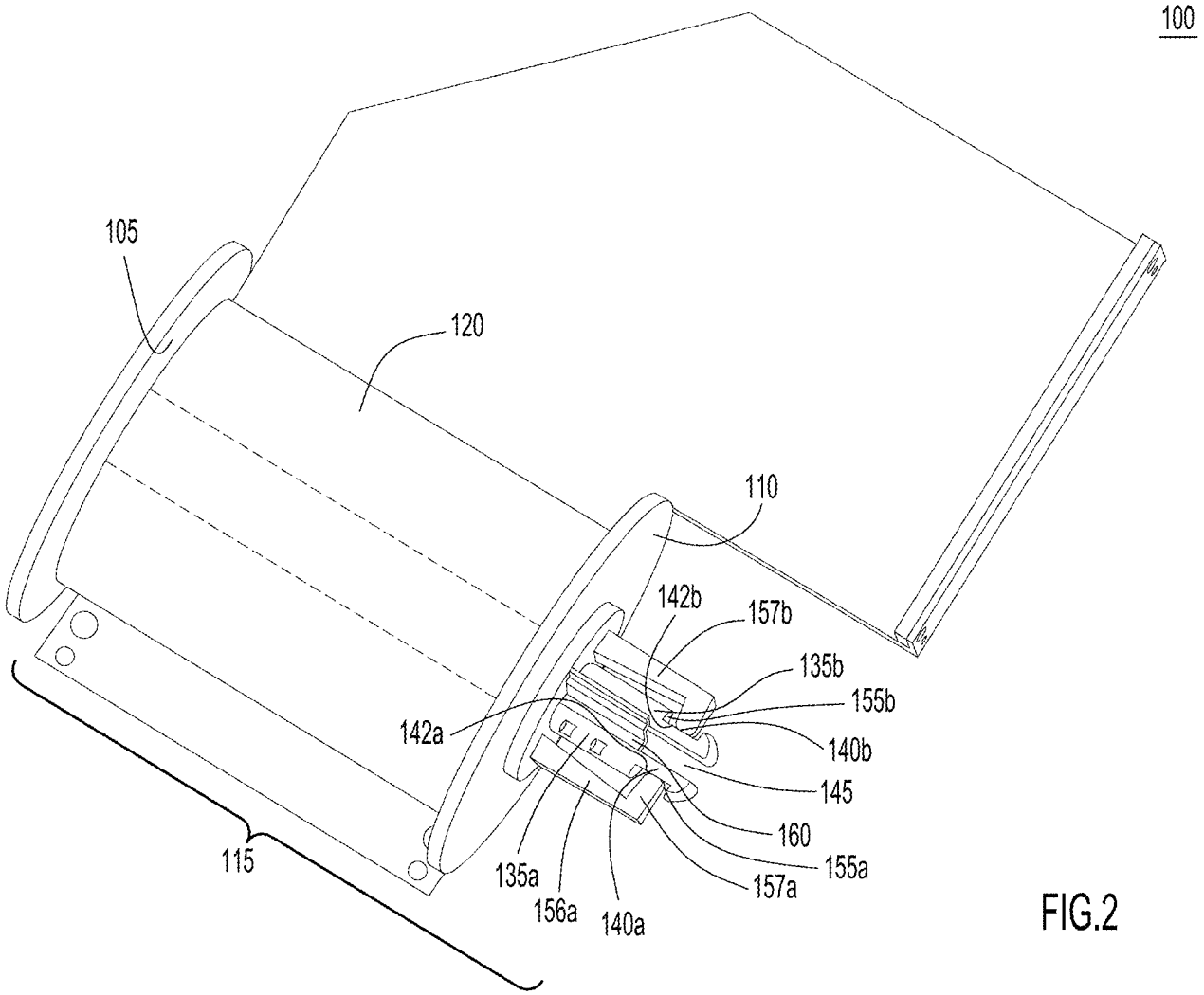
FIG. 2 is a view of the tool-less cable retainer of FIG. 1, and illustrating how the cable retainer secures a cable between a first flange and a second flange.

With reference now made to FIG. 2, illustrated therein is cable retainer 100 when spindle 115 is attached to second flange 110. Specifically, first leg 135*a* and second leg 135*b* are illustrated as extending through hole 150 so that first male portion 155*a* and second male portion 155*b* engage with first female portion 140*a* and second female portion 140*b*. In order to align male portion 155*a* with female portion 140*a*, male portion 155*a* has a first portion 156*a* and second portion 157*a*. First portion 156*a* extends axially out from second flange 110 a distance equal to that which female portion 140 extends past second flange 110. Second portion 157*b* then extends radially inward to engage with female portion 140*a*. Second male portion 155*b* similarly includes first portion 156*b* and second portion 157*b* to engage with female portion 140*b*.

In order to separate spindle 115 from second flange 110, first male portion 155*a* and second male portion 155*b* can be radially deformed outward so that second axial end 130 can be removed from hole 150. Specifically, second portion 157*a* of male portion 155*a* clears inner face 142*a* of first leg 135*a* and second portion 157*b* of male portion 155*b* clears inner face 142*b* of second leg 135*b* as spindle 115 is moved in a first-flange axial direction. Alternatively or in addition to radially deforming first male portion 155*a* and second male portion 155*b*, first leg 135*a* and second leg 135*b* can be elastically deformed radially inward. Specifically, first leg 135*a* can be radially deformed so that second portion 157*a* of male portion 155*a* clears inner face 142*a* of first leg 135*a* as spindle 115 is moved in a first-flange axial direction. Similarly, second leg 135*b* can be radially deformed to that second portion 157*b* of male portion 155*b* clears inner face 142*b* of second leg 135*b* as spindle 115 is moved in a first-flange axial direction.

Also illustrated in FIG. 2 is cross member 160 arrange within slit 145. As shown, cross member 160 extends axially from second flange 110, but not so far that it would inhibit the radial deformation of first leg 135*a* and second leg 135*b*. As a result, cross member 160 does not prevent second portion 157*a* of male portion 155*a* from clearing inner face 142*a* of first leg 135*a* and second portion 157*b* of male portion 155*b* from clearing inner face 142*b* of second leg 135*b* as spindle 115 is moved in a first-flange axial direction. In example embodiments in which only male portions 155*a* and 155*b* are radially deformed, cross member 160 may extend to and past the end of first leg 135*a* and second leg 135*b*.

In example embodiments in which male portions 155*a* and 155*b* are radially deformed to allow for the detachment of spindle 115 from second flange 110, male portions 155*a* and 155*b* may have a height (length) (i.e., a measurement in the direction perpendicular to that of the radial and axial directions in which male portions 155*a* and 155*b* extend) that is greater than that of first leg 135*a* and second leg 135*b*. Such a height (length) allows a user to grasp and deform male portions 155*a* and 155*b* without interference from first leg 135*a* and second leg 135*b*.

In example embodiments in which first leg 135*a* and second leg 135*b* are radially deformed to allow for the detachment of spindle 115 from second flange 110, first leg 135*a* and second leg 135*b* may axially extend past male portions 155*a* and 155*b*. Such an extension allows a user to grasp and deform first leg 135*a* and second leg 135*b* without interference from male portions 155*a* and 155*b*.

Figure 3:
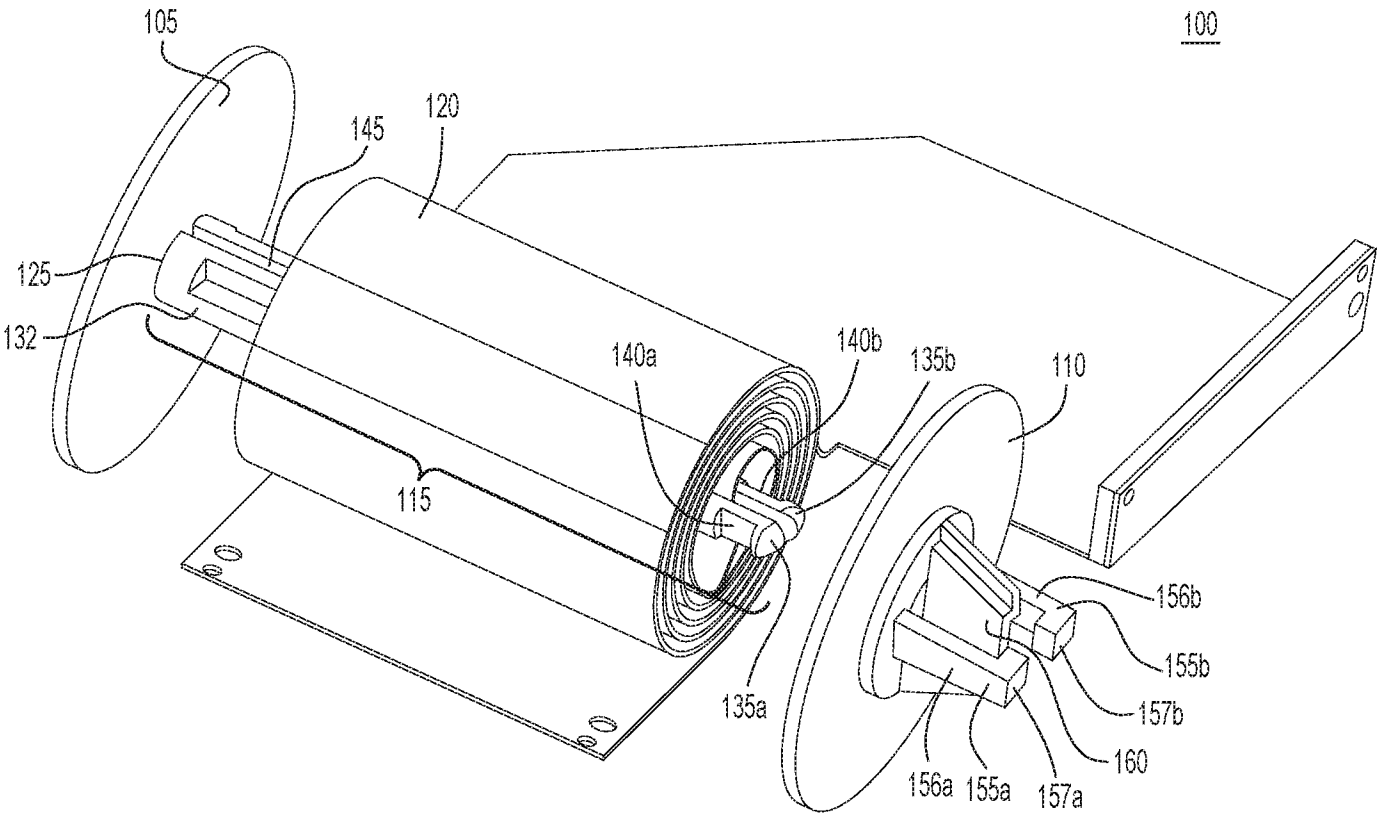
FIG. 3 is another exploded view of the tool-less cable retainer of FIG. 1, and illustrating how the cable retainer secures a cable along the axial body of the cable retainer.

With reference now made to FIG. 3, depicted therein is cable retainer 100 in a partially exploded view, illustrating how cable 120 is retained on spindle 115 between first flange 105 and second flange 110. Specifically, prior to insertion of second axial end 130 through hole 150, a portion of cable 120 is arranged within the portion of slit 145 which extends through axial body 132. Accordingly, so long as axial body 132 is attached to second flange 110, cable 120 will be prevented from disengaging from cable retainer 100. Specifically, first flange 105 and second flange 110 will prevent cable 120 from sliding out of slit 145. On the other hand, because second flange 110 can be easily removed from spindle 115, as described above with reference to FIGS. 1 and 2, cable 120 may be easily removed from cable retainer 100 without the use of a tool for, for example, maintenance and/or installation of a new cable.

Figure 4:
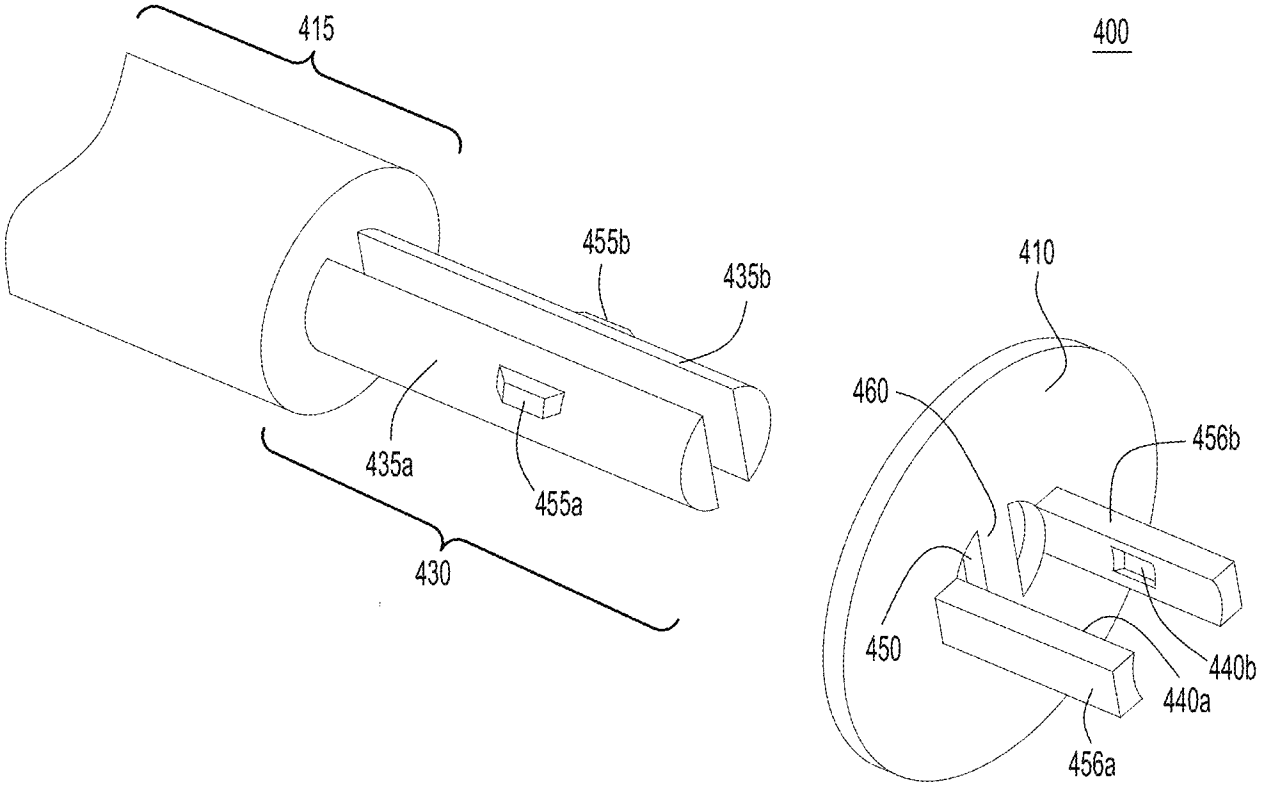
FIG. 4 is an illustration of a tool-less cable retainer according to a second example embodiment.

With reference now made to FIG. 4, depicted therein is an example embodiment of a cable retainer 400. In this embodiment, the first and second male portions 455*a* and 455*b* are arranged on first and second legs 435*a* and 435*b* of second axial end 430, while first and second female portions 440*a* and 440*b* are arranged on first portions 456*a* and 456*b*, respectively. Spindle 415 is similar to spindle 115 of FIGS. 1-3, as it can be secured to second flange 410 by inserting first and second legs 435*a* and 435*b* through hole 450. While the location of the male portions 455*a* and 455*b* and female portions 440*a* and 440*b* differ from those of the embodiments of FIGS. 1-3, spindle 415 may still be removed from second flange 410 by elastically deforming one or more of first leg 435*a*, second leg 435*b*, first portion 456*a* and/or first portion 456*b* in a radial direction. In order to facilitate their elastic deformation, first leg 435*a* and second leg 435*b* may extend past first portions 456*a* and 456*b* in an axial direction. In order to facilitate the elastic deformation of first portions 456*a* and 456*b*, first portions 456*a* and 456*b* may have a height (length) (i.e., a measurement in the direction perpendicular to that of the radial direct and the axial directions in which first portions 456*a* and 456*b* extend) that is greater than that of first leg 435*a* and second leg 435*b*.

Figure 5:
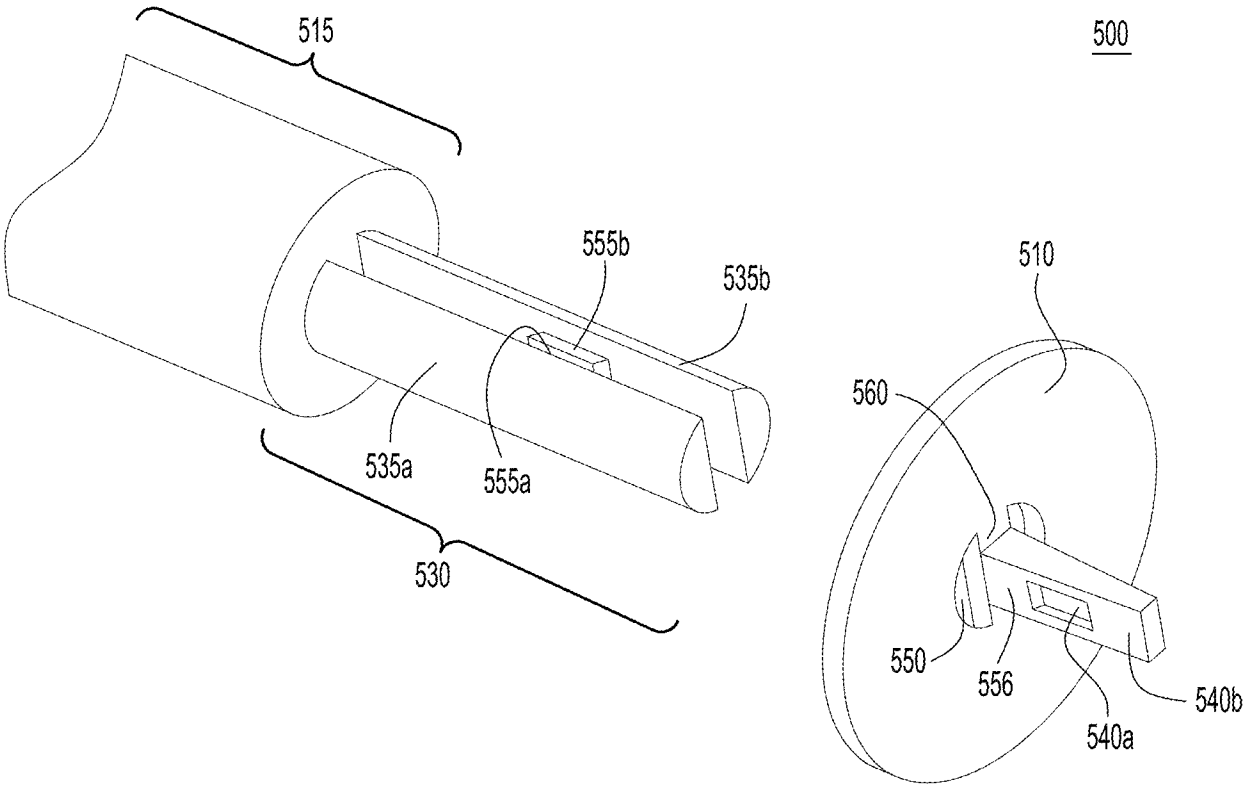
FIG. 5 is an illustration of an example tool-less cable retainer according to a third example embodiment.

With reference now made to FIG. 5, depicted therein is an example embodiment of a cable retainer 500 in which the first and second male portions 555*a* and 555*b* are arranged on first and second legs 535*a* and 535*b* of second axial end 530. Cable retainer 500 contains a single first portion 556 arranged on cross bar 560. According to this example embodiment, spindle 515 may still be easily removed from second flange 510 by elastically deforming one or more of first leg 535*a* and/or second leg 535*b*. In order to facilitate their elastic deformation, first leg 535*a* and second leg 535*b* may extend past first portion 556 in an axial direction. First leg 535*a* and second leg 535*b* may also have a height (i.e., a measurement in the direction perpendicular to that of the radial direct and the axial directions in which first leg 535*a* and second leg 535*b* extend) that is greater than that of first portion 556.

Figure 6:
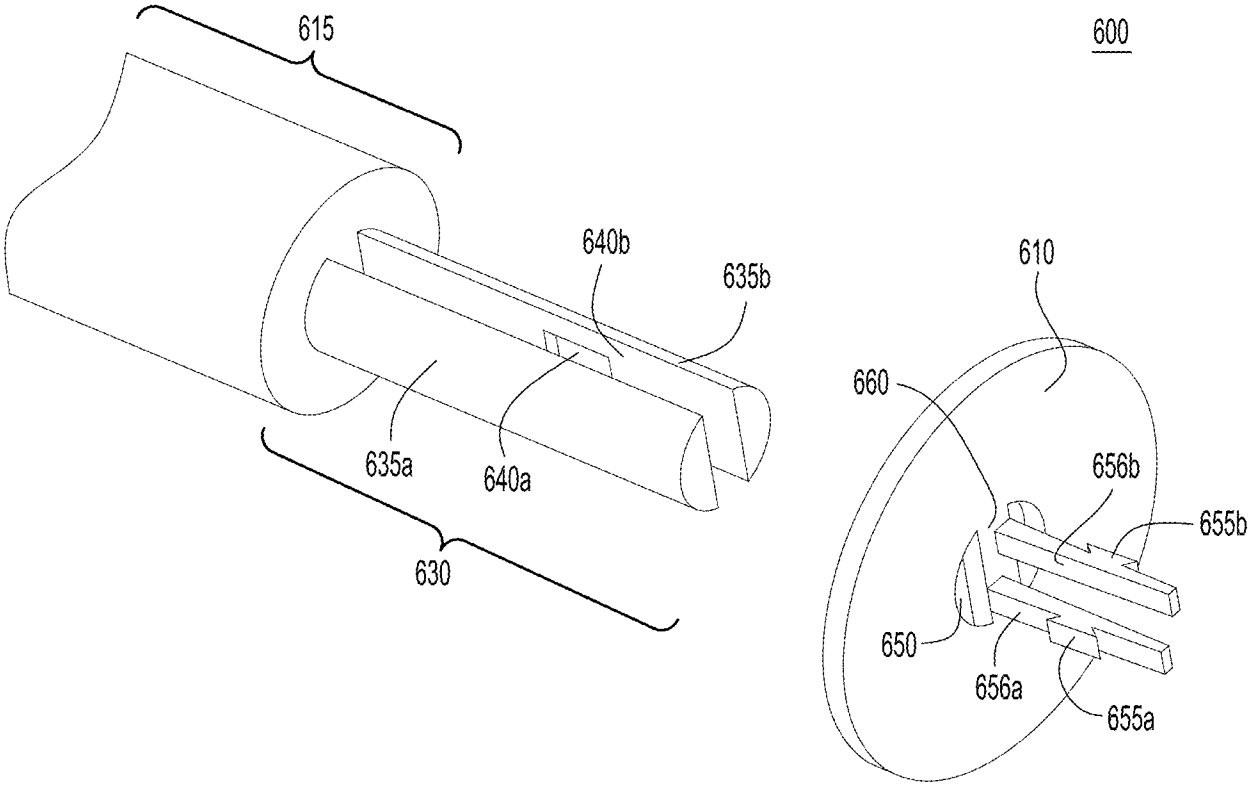
FIG. 6 is an illustration of a tool-less cable retainer according to a fourth example embodiment.

With reference now made to FIG. 6, depicted therein is an example embodiment of a cable retainer 600 in which first portions 656*a* and 656*b* are arranged on cross member 660. In this example embodiment, male portions 655*a* and 655*b* are arranged on first portions 656*a* and 656*b* which are located on cross member 660, while female portions 640*a* and 640*b* are arranged on first leg 635*a* and second leg 635*b*, respectively. Spindle 615 may still be easily removed from second flange 610 by elastically deforming one or more of first leg 635*a*, second leg 635*b*, first portion 656*a* and/or first portion 656*b* in a radial direction. In order to facilitate their elastic deformation, first leg 635*a* and second leg 635*b* may extend past first portions 656*a* and 656*b* in an axial direction. In order to facilitate the elastic deformation of first portions 656*a* and 656*b*, first portions 656*a* and 656*b* may have a height (length) (i.e., a measurement in the direction perpendicular to that of the radial direct and the axial directions in which first portions 656*a* and 656*b* extend) that is greater than that of first leg 635*a* and second leg 635*b*.

Figure 7:
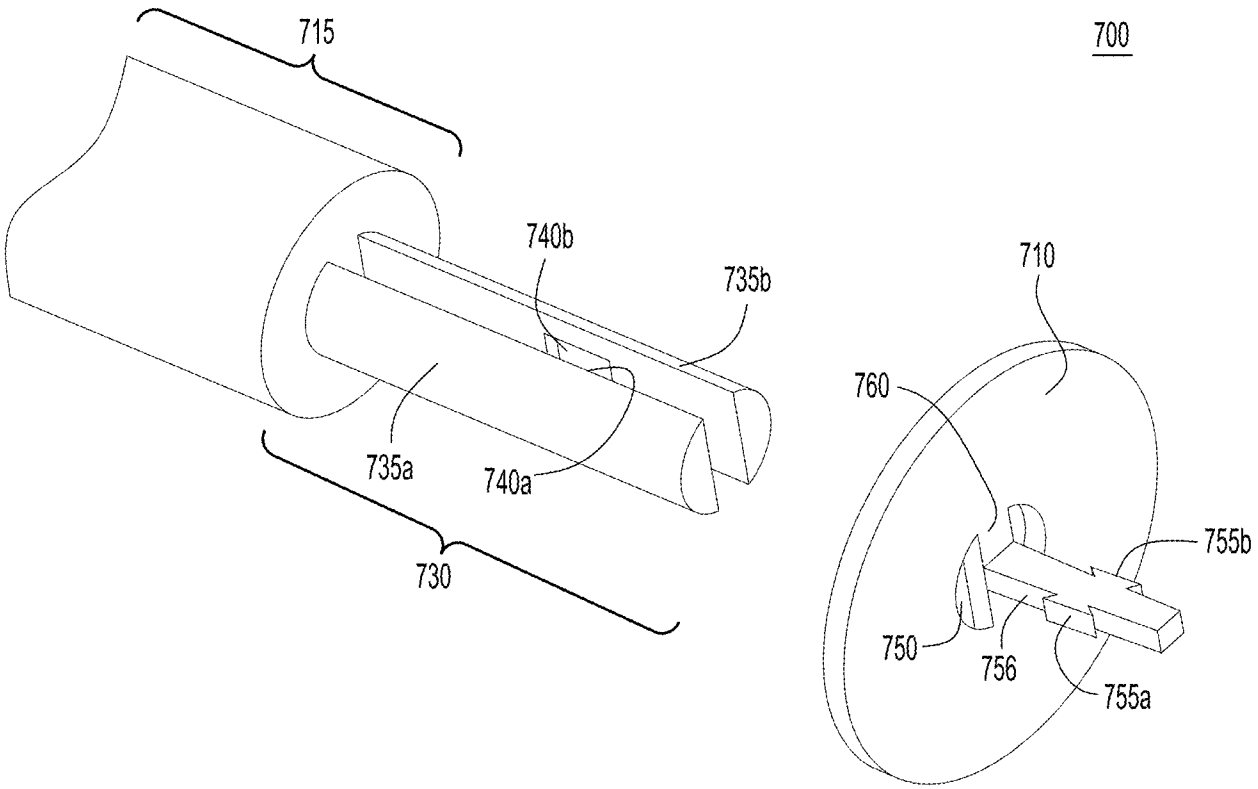
FIG. 7 is an illustration of a tool-less cable retainer according to a fifth example embodiment.

With reference now made to FIG. 7, depicted therein is an example embodiment of a cable retainer 700 that is similar to cable retainer 500 of FIG. 6, but differs from cable retainer 600 in that male portions 755*a* and 755*b* are arranged on a single first portion 756 on cross bar 760, and female portions 740*a* and 740*b* are arranged on first leg 735*a* and second leg 735*b*, respectively. According to this example embodiment, spindle 715 may still be easily removed from second flange 710 elastically deforming one or more of first leg 735*a* and/or second leg 735*b*. In order to facilitate their elastic deformation, first leg 735*a* and second leg 735*b* may extend past first portion 756 in an axial direction. First leg 735*a* and second leg 735*b* may also have a height (i.e., a measurement in the direction perpendicular to that of the radial direction and the axial directions in which first leg 735*a* and second leg 735*b* extend) that is greater than that of first portion 756.

To summarize, presented herein are various embodiments of a tool-less cable retention assembly that snaps together and holds a cable together during use, preventing it from coming apart in the side to side direction. In simple terms, the assembly is made of two plastic parts, the first with a retaining disk at one end and a long split shaft that extends out. The second part has a disk design with two holes in it. The long part is pushed through the center of the cable and then is snapped into the second part on the other end. This assembly is tool-less and can be disassembled by spreading the two snaps at the end and pulling apart. This assembly retains the cable and prevents it from spreading out side ways during use.

Thus, in one form, an apparatus is provided comprising: a first flange part; a second flange part comprising a hole and one of a male portion or a female portion; and a spindle comprising a first axial end, an axial body, a second axial end and an other of the male portion or the female portion arranged on the second axial end of the spindle, wherein: the first axial end of the spindle is rigidly connected to the first flange part; the second axial end of the spindle extends through the hole so that the male portion extends into the female portion to secure the spindle part to the second flange part and so that the axial body extends between the first flange part and the second flange part; and the male portion or the female portion is elastically deformable to allow the male portion to be removed from the female portion and the spindle to be removed (unsecured) from the second flange part.

In another form, an apparatus is provided comprising: a first flange part; a second flange part comprising a hole and a cross member extending along a diameter of the hole; a spindle comprising a first axial end, an axial body, and a second axial comprising a first leg and a second leg separate by a slit, wherein: the first axial end of the spindle is rigidly connected to the first flange part; and the second axial end of the spindle extends through the hole so that the first leg extends axially through the hole on a first side of the cross member, the second leg extends through the hole on a second side of the cross member, and the cross member extends into the slit so that the cross member prevents rotation of the spindle.

In still another form, a method is provided comprising: providing a first flange part; providing a second flange part comprising a hole and one of a male portion or a female portion; providing a spindle comprising a first axial end, an axial body, a second axial end and an other of the male portion or the female portion arranged on the second axial end of the spindle, wherein the first axial end of the spindle is rigidly connected to the first flange part; extending the second axial end of the spindle through the hole so that the male portion extends into the female portion to secure the spindle part to the second flange part and so that the axial body extends between the first flange part and the second flange part; and elastically deforming the male portion or the female portion to allow the male portion to be removed from the female portion and the spindle to be unsecured from the second flange part.

The above description is intended by way of example only.

What is claimed is:

1. An apparatus comprising:

a first flange part;

a second flange part comprising a hole, a cross member that extends across the hole and also extends axially away from the hole and an outside face of the second flange part, and one of a male portion or a female portion; and a spindle comprising a first axial end, an axial body, and a second axial end including: (1) a first leg and a second leg that are separated by a slit; and (2) an other of the male portion or the female portion, wherein:

the first axial end of the spindle is rigidly connected to the first flange part;

the spindle is secured to the second flange part so that the axial body extends between the first flange part and the second flange part when the first leg and the second leg extend through the hole, the male portion engages the female portion and the cross member is arranged within the slit; and the male portion or the female portion is deformable to allow the male portion to be removed from the female portion and the spindle to be removed from the second flange part.

2. The apparatus of claim 1, wherein:

the second flange part comprises the male portion; and at least one of the first leg or the second leg comprises the female portion.

3. The apparatus of claim 2, wherein:

the male portion comprises a first portion which extends axially away from the outside face of the second flange part beyond the cross member, and a second portion which extends radially inward from the first portion.

4. The apparatus of claim 2, wherein:

the first leg and the second leg are configured to elastically deform radially inward to allow the male portion to be removed from the female portion.

5. The apparatus of claim 2, wherein the female portion extends radially into the at least one of the first leg or the second leg.

6. The apparatus of claim 1, wherein the slit extends axially from the second axial end into the axial body when the male portion extends into the female portion.

7. The apparatus of claim 1, further comprising a cable that passes through the slit and wraps around the axial body.

8. The apparatus of claim 1, wherein the second axial end has a first radius, the hole has a second radius, and the axial body has a third radius, wherein the first radius is smaller than the second radius, and the second radius is smaller than the third radius.

9. The apparatus of claim 1, wherein the spindle is monolithically formed with the first flange part.

10. The apparatus of claim 1, wherein the spindle is secured directly to the second flange part to prevent rotation of the spindle with respect to the second flange part.

11. An apparatus comprising:

a first flange part;

a second flange part comprising a hole and a cross member that extends along a diameter of the hole and also extends axially away from the hole and an outside face of the second flange part;

a spindle comprising a first axial end, an axial body, and a second axial end comprising a first leg and a second leg separated by a slit, wherein:

the first axial end of the spindle is rigidly connected to the first flange part; and the second axial end of the spindle extends through the hole so that the first leg of the second axial end extends axially through the hole on a first side of the cross member, the second leg of the second axial end extends through the hole on a second side of the cross member, and the cross member extends into the slit so that the cross member prevents rotation of the spindle with respect to the second flange part.

12. The apparatus of claim 11, wherein:

the first leg comprises a first male portion;

the second leg comprises a second male portion;

the second flange part comprises a first female portion and a second female portion; and the second axial end of the spindle extends through the hole so that the first male portion engages the first female portion, the second male portion engages the second female portion; and the first male portion is configured to engage with the first female portion and the second male portion is configured to engage with the second female portion so as to prevent the spindle from moving axially relative to the second flange part.

13. The apparatus of claim 12, further comprising a cable that passes through the slit and wraps around the axial body.

14. The apparatus of claim 12, wherein at least one of the first leg, the second leg, the first female portion or the second female portion is elastically deformable to allow the spindle to be unsecured from the second flange part.

15. The apparatus of claim 11, wherein:

the first leg comprises a first female portion;

the second leg comprises a second female portion;

the second flange part comprises a first male portion and a second male portion that each extend axially away from the outside face of the second flange; and the second axial end of the spindle extends through the hole so that the first male portion engages the first female portion at a first position exterior of the outside face of the second flange and the second male portion engages the second female portion at a second position exterior of the outside face of the second flange; and the first male portion is configured to engage with the first female portion and the second male portion is configured to engage with the second female portion so as to prevent the spindle from moving axially relative to the second flange part.

16. The apparatus of claim 15, wherein at least one of the first leg, the second leg, the first male portion or the second male portion is elastically deformable to allow the spindle to be unsecured from the second flange part.

17. The apparatus of claim 11, further comprising a cable that passes through the slit and wraps around the axial body.

18. A method comprising:

providing a first flange part;

providing a second flange part comprising a hole, a cross member that extends across the hole and that also extends axially away from the hole and an outside face of the second flange part, and one of a male portion or a female portion;

providing a spindle comprising a first axial end, an axial body, and a second axial end including: (1) a first leg and a second leg that are separated by a slit; and (2) an other of the male portion or the female portion, wherein the first axial end of the spindle is rigidly connected to the first flange part;

extending the first leg and the second leg of the second axial end of the spindle through the hole so that the male portion engages the female portion and the cross member is arranged within the slit to secure the spindle to the second flange part and so that the axial body extends between the first flange part and the second flange part; and elastically deforming the male portion or the female portion to allow the male portion to be removed from the female portion and the spindle to be unsecured from the second flange part.

19. The method of claim 18, wherein the extending comprises:

extending the first leg of the second axial end through the hole on a first side of the cross member; and extending the second leg of the second axial end through the hole on a second side of the cross member.

20. The method of claim 18, wherein the second flange part includes the male portion and the male portion comprises:

a first portion which extends axially away from the outside face of the second flange part beyond the cross member; and a second portion which extends radially inward from the first portion.

* * * * *